United States Patent [19]

Jordan, Jr. et al.

[11] Patent Number: 4,903,777

[45] Date of Patent: Feb. 27, 1990

[54] DUAL SEAL PACKER FOR CORROSIVE ENVIRONMENTS

[75] Inventors: Henry J. Jordan, Jr., Huntsville; Frank X. Mooney, The Woodlands; John L. Baugh; Charles A. Ledet, both of Huntsville, all of Tex.

[73] Assignee: Baker Hughes, Incorporated, Houston, Tex.

[21] Appl. No.: 90,431

[22] Filed: Aug. 26, 1987

Related U.S. Application Data

[63] Continuation-in-part of Ser. No. 922,592, Oct. 24, 1986.

[51] Int. Cl.[4] ..... E21B 33/129

[52] U.S. Cl. ..... 166/387; 166/134

[58] Field of Search ..... 166/387, 124, 134, 139, 166/140, 181, 191

[56] References Cited

U.S. PATENT DOCUMENTS

| | | | |
|---|---|---|---|
| 1,853,474 | 4/1932 | Tucker | 166/123 |
| 2,764,243 | 9/1956 | Page | 166/119 |
| 2,765,852 | 10/1956 | Brown | 166/119 |
| 2,822,874 | 2/1958 | Brown | 166/119 |
| 3,695,352 | 10/1972 | McGill | 166/129 |
| 3,749,166 | 7/1973 | Young | 166/123 |
| 4,149,594 | 4/1979 | Evans | 166/134 |
| 4,427,063 | 1/1984 | Skinner | 166/134 |
| 4,548,264 | 10/1985 | Manderscheid | 166/139 |
| 4,627,491 | 12/1986 | Zunkel | 166/126 |

*Primary Examiner*—William P. Neuder

*Attorney, Agent, or Firm*—Charles D. Gunter, Jr.

[57] ABSTRACT

A dual seal packer is shown having a central mandrel which carries upper and lower seal assemblies which straddle an outer cage assembly. Rocker type slips are carried in the cage assembly and are set by a single expander ring. Special support surfaces on the slips cooperate with mating support surfaces on the cage assembly to provide support for the slips under tensive and compressive loading. The slips and upper and lower seal assemblies are set in a single step operation by rotating the mandrel to the right while holding tension on the well string from the surface.

22 Claims, 5 Drawing Sheets

DUAL SEAL PACKER FOR CORROSIVE ENVIRONMENTS

CROSS REFERENCE TO RELATED APPLICATIONS

This application is a continuation-in-part of application Ser. No. 922,592, filed 10/24/86.

BACKGROUND OF THE INVENTION

1. Field of the Invention

This invention relates to devices and techniques for sealing cylindrical members to circumscribing conduits within a well bore. More specifically, the invention relates to a well packer for sealing a pipe string to a surrounding well conduit, such as is provided by the casing or liner, and is suitable for use in corrosive environments.

2. Description of the Prior Art

Well packers and other downhole equipment are often subjected to corrosive environments. One particular problem area is the injection of carbon dioxide during well stimulation techniques. Because carbon dioxide adversely effects the metal parts of the packer, it is advantageous to provide a packer with upper and lower sealing elements which protect the mechanically operated anchoring components from the corrosive environment.

The present invention has as its object the provision of a dual seal well packer which can be both set and released by right hand rotation of the well string leading to the well surface.

Another object of the invention is the provision of such a well packer of simplified design which utilizes rocker type slips which are engaged with the surrounding well casing by a single expander ring to resist axial loading in a first axial direction.

Another object of the invention is the provision of such a well packer which utilizes a slip having a support surface which engages a mating support surface of the slip cage for resisting axial loading in a second axial direction.

Another object is to provide such a device which is set by means of a tension sleeve and dog arrangement which allow the device to be set multiple times and released by right hand rotation from the well surface.

Another object is to provide such a device which can be optionally released by a straight pull on the well string from the well surface.

These and other objects are accomplished as described in the specification which follows:

SUMMARY OF THE INVENTION

The dual seal packer of the invention has a central mandrel having an external surface and upper connecting means for connection in a well string extending to the well surface. A cage assembly circumscribes the mandrel at one axial location. A lower seal assembly is carried on the mandrel below the cage assembly and above a lower abutment. An expander ring is carried about the mandrel above the lower seal assembly. The expander ring is axially slidable with respect to the lower seal assembly and has a compression surface for contacting the lower seal assembly. The expander ring also has an oppositely arranged, tapered cone surface. The lower seal assembly is expansible radially outward upon contact with the compression surface of the expander ring between a retracted position and an extended position in engagement with the surrounding conduit.

A plurality of rocker type slips are carried about the mandrel at spaced circumferential locations above the expander ring within windows provided in the cage assembly. Each slip has an upper gripping surface, a tapered lower surface for engagement with the cone surface of the expander ring, an oppositely tapered support surface, and a pivot point which allows the slip to pivot between a retracted position and an extended gripping position in which the slip engages the surrounding conduit. The cage assembly is provided with a mating support surface located at the approximate pivot point of each of the slips for engaging the support surface of each slip when the cone surface of the expander ring engages the tapered lower surface of the slip and the slip moves to the extended, gripping position.

An upper seal assembly is carried on the mandrel above the cage assembly and below an upper abutment. The central mandrel has upper and lower externally threaded regions which are spaced apart on the mandrel exterior surface. The upper threaded region is engagable with an internally threaded running ring when the seal assemblies and slips are in the retracted position. The lower threaded region is engagable with an internally threaded setting ring when the seal assemblies and slips are in the extended position. The upper and lower externally threaded regions of the central mandrel are spaced-apart a predetermined distance. The distance is selected to allow the lower externally threaded region to engage the setting ring internally threaded surface as the upper and lower seals are being extended to hold the seals in the extended position.

The cage assembly includes a plurality of dogs which are carried about the mandrel in spaced circumferential locations. The dogs are received on the central mandrel outer surface and are both slidable along the longitudinal axis of the mandrel and rotatable about the circumference of the mandrel. The dogs are engagable with an external shoulder on the central mandrel and through a tension sleeve with the upper seal assembly, whereby tension applied through the mandrel shoulder and through the dogs is communicated through the tension sleeve to the upper seal assembly to move the seal assembly to the extended position.

DESCRIPTION OF THE PREFERRED EMBODIMENT

Figures 1A, 1B, 1C:
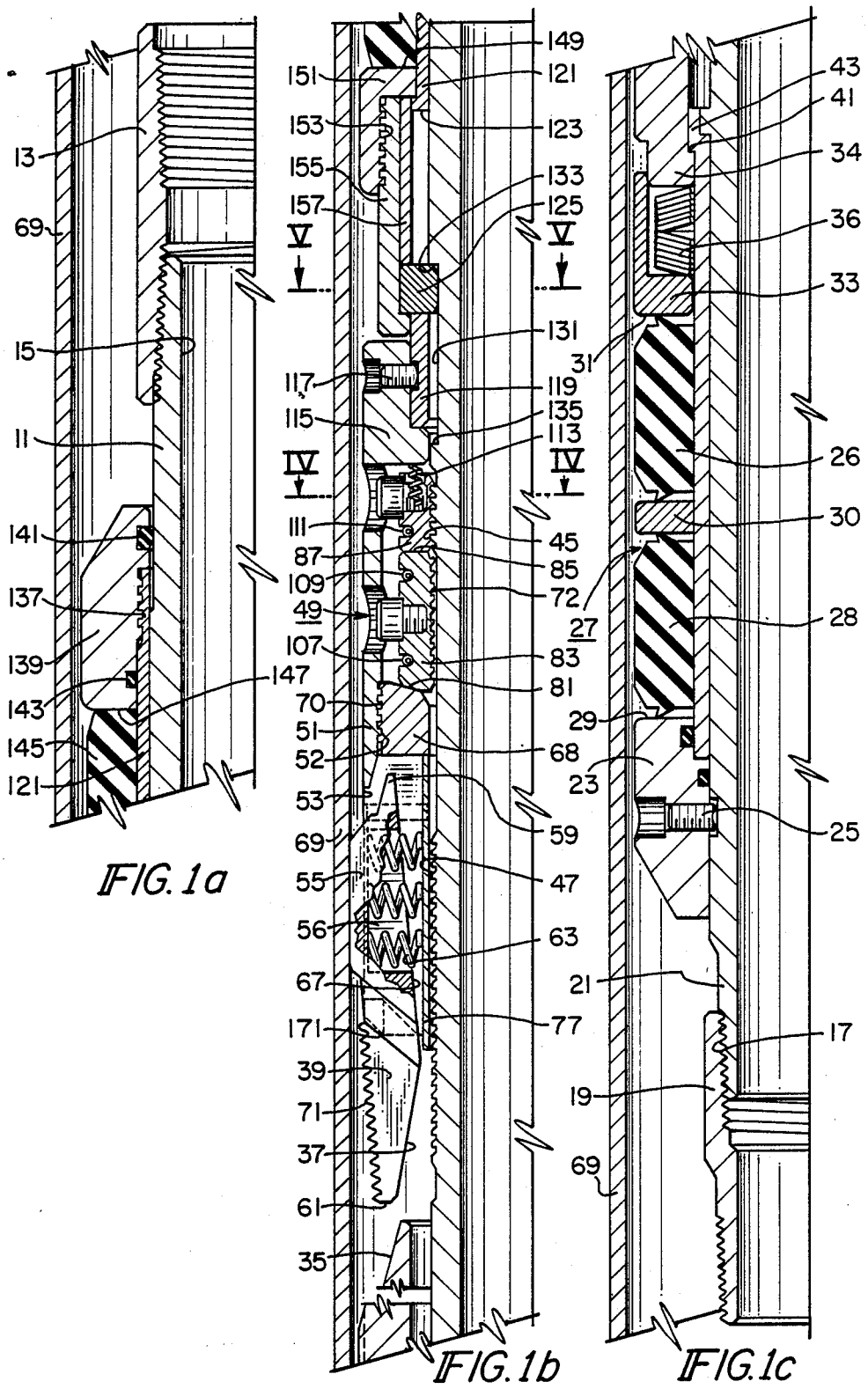
FIG. 1*a* is a side, cross-sectional view of the upper end of the well packer of the invention in the running-in position.
FIG. 1*b* is a downward continuation of FIG. 1*a*, showing the sealing and gripping means thereof.
FIG. 1*c* is a downward continuation of FIG. 1*b*, showing the lower end of the well packer of the invention.

The dual seal packer of the invention includes a central, tubular mandrel 11 having upper connecting means, such as box 13 for connection in a well string (not shown) leading to the well surface. The mandrel 11 also has an internal bore 15 which communicates with the bore of the well string for conducting well fluids to or from the well bore. In the embodiment shown, the central mandrel 11 has an externally threaded extent 17 which is shown engaging an internally threaded coupling 19. The mandrel lower extent 21 has a ring-shaped lower abutment 23 mounted thereon, as by plurality of circumferentially spaced shear screws 25.

A lower seal assembly 27 is received upon an upper surface 29 of the abutment 23 and is engaged by the compression surface 31 of an expander ring 33. The seal assembly 27 includes upper and lower seal rings 26, 28 which are separated by a spacer ring 30. The expander ring 33 surrounds the mandrel 11 and is separated from an expander member 34 by Bellville springs 36 which are carried within a recess of the expander ring 33. The expander ring includes an externally tapered cone surface 35 which is adapted to engage the mating tapered lower surface 37 of a rocker type slip 39. As shown in FIG. 1*c*, the expander member 34 has an internal lip 41 which is adapted to engage a flange region 43 on the mandrel 11. The flange region 43 restricts upward axial travel of the expander member 34 but allows the expander and expander ring 33 to move downwardly in the direction of the seal assembly 27.

The mandrel 11 is also provided with upper and lower threaded regions 45, 47. The upper threaded region 45 is provided with left hand buttress threads while the lower threaded region 47 is provided with right hand buttress threads.

As shown in FIG. 1*b*, the central mandrel 11 is received within a cage assembly, designated generally as 49. The cage assembly 49 includes a cage 68 which is provided with window openings 53 into which are received the drag block portions 55 of the rocker type slips 39. As will be explained, each rocker type slip 39 is a single, unitary metal body which has pivot point approximately mid-way between the ends 59, 61 thereof. Each of the slips 39 is provided with a recess 56 in the lower surface 67 thereof. One or more coil springs 63 are contained within the recess 56 and are separated from the mandrel 11 by a sleeve 77 which underlies the drag bock portion 55 of each slip 39.

Figure 4:
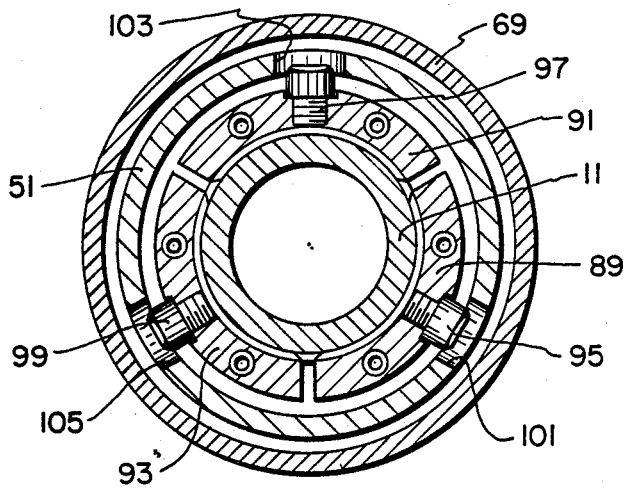
FIG. 4 is cross-sectional view taken along lines IV—IV in FIG. 1*b*.

The cage 68 has an externally threaded upper end 70 with an upper tapered surface 81 onto which is received the lower surface of a segmented setting ring 83. The setting ring 83 has a top surface 85 onto which is received the lower surface of a segmented running ring 87. As best shown in FIG. 4, each of the rings 83, 87 includes three segments 89, 91, 93 which are circumferentially spaced about the mandrel 11 and which are held in place by means of screws 95, 97, 99 which are received within openings 101, 103, 105 of a ring housing 51. Ring housing 51 has an internally threaded lower extent 52 which is engaged by a mating externally threaded surface of the cage upper end 70.

The setting ring 83 has an internally threaded ratchet surface 72 adapted to ratchet into engagement with the lower threaded region 47 of the mandrel 11. The running ring 87 has an internally threaded surface which initially engages the upper threaded region 45 of the mandrel 11. Garter springs, 107, 109, 111, are received within external grooves on the rings 83, 87 to hold the respective ring about the mandrel 11. One or more coil springs 113 normally biases rings 83, 87 in the direction of the cage 68.

Figure 5:
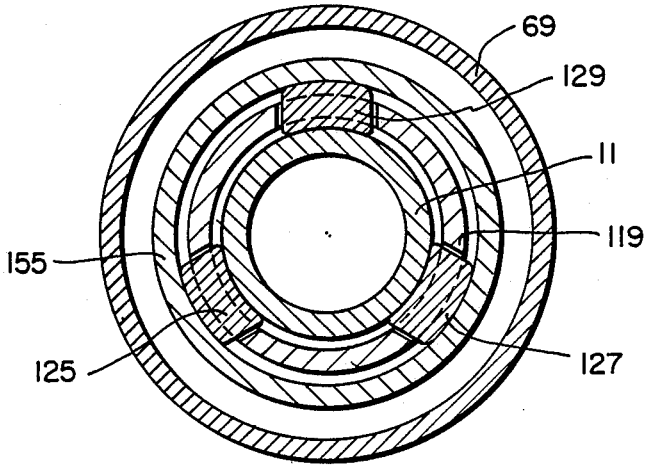
FIG. 5 is a cross-sectional view taken along lines V—V in FIG. 1*b*.

The ring housing 51 has an upper extent 115 which is connected by means of a plurality of shear pins 117 to the lower extent 119 of an internal sleeve 121. The sleeve 121 includes a slot 123 into which is received a plurality of dogs 125. As shown in FIG. 5, there are preferably three dogs 125, 127, 129 spaced at 120° circumferential locations about the mandrel 11. The dogs 125, 127, 129 are both rotatably and slidably received within a region of decreased external diameter 131 on the exterior of the mandrel 11. This region is defined between upper and lower shoulders 133, 135.

As shown in FIG. 1*a*, an upper, externally threaded extent 137 of the internal sleeve 121 threadedly engages the internal surface of an upper abutment 139. O-ring seals 141, 143 seal against the exterior surfaces of the mandrel 11 and internal sleeve 121, respectively. An upper expansible seal assembly 145 is located between a lower surface 147 of the upper abutment 139 an upper surface 149 of a tension ring 151. The tension ring 151 has an internally threaded surface 153 which engages the externally threaded surface of downward extension 155. The downward extension 155 has an internal bore which receives a tension sleeve 157 which rests upon the dogs 125 and which surrounds a portion of the internal sleeve 121.

Figure 6:
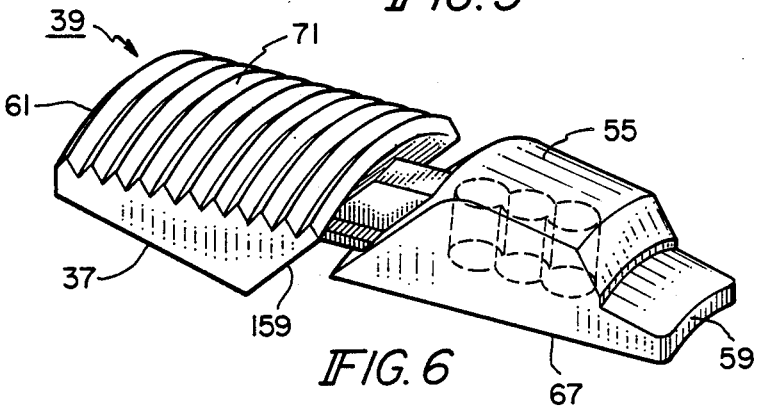
FIG. 6 is an isolated, perspective view of a rocker type slip used in the well packer of FIG. 1.

FIG. 6 shows the rocker type slip 39 used in the packer of the invention. In addition to the tapered lower surface 37, the slip 39 has an oppositely tapered support surface 159 which slopes in an opposite direction from the tapered lower surface 37. A shown in FIG. 9, the lower surface 67 of the drag block end 55 of slip 39 defines a reference plane represented by imaginary line 161. The tapered lower surface 37 forms and acute angle alpha with respect to the imaginary line 161 drawn through the plane of the bottom surface 67. The oppositely tapered support surface 159 forms an obtuse angle beta with the imaginary line 161.

Figure 7:
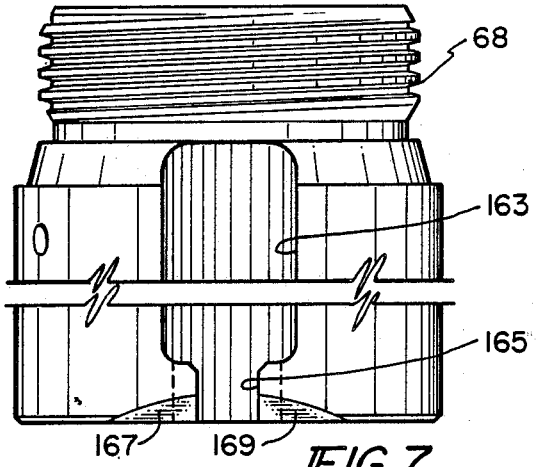
FIG. 7 is a top, isolated view of the cage assembly used with the rocker type slip of FIG. 6.
Figure 8:
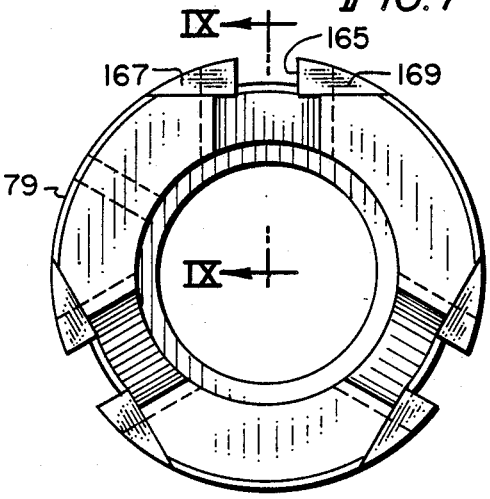
FIG. 8 is an end view of cage assembly of FIG. 7.

As shown in FIG. 7, the cage 68 is a tubular body having a plurality of longitudinal slots 163 formed therein, a portion of each slot forming a window for receiving the drag block portion 55 of a slip 39. The width of each slot 163 narrows at the mouth region 165 thereof and the upper surface of each mouth region is beveled to form an angular profile 167, 169 which is complementary to the tapered support surface 159 of each slip 39.

Figure 9:
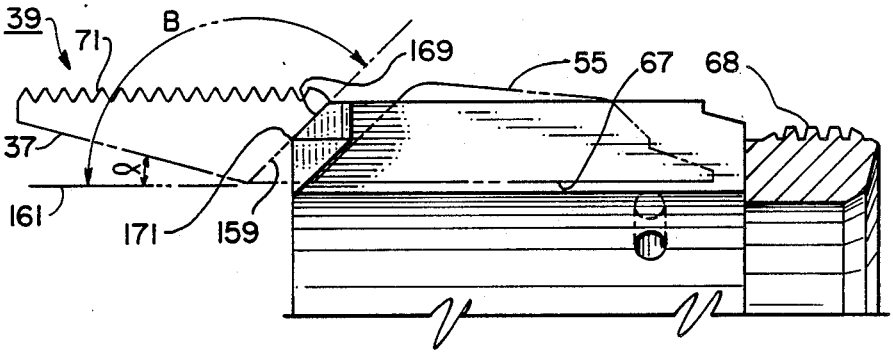
FIG. 9 is a side, cross-sectional view of a slip within the cage assembly of FIG. 7 showing the mating support surfaces of the slip and cage assembly.

As shown in FIG. 9, the support surface 169 forms a pivot point 171 for each slip 39 which allows the slip to pivot between a retracted position and an extended gripping position in which the slip engages the surrounding conduit. As the slip engages the tapered cone surface 35 of the expander ring, the tapered support surface 159 pivots about the point 171 and makes contact with the mating support surface 169 of the cage. In this way, the expander surface 35 supports the slip against axial loads imposed in one direction and the mating support surface 169 of the cage supports the slip from loads imposed in the opposite axial direction.

Figure 2A:
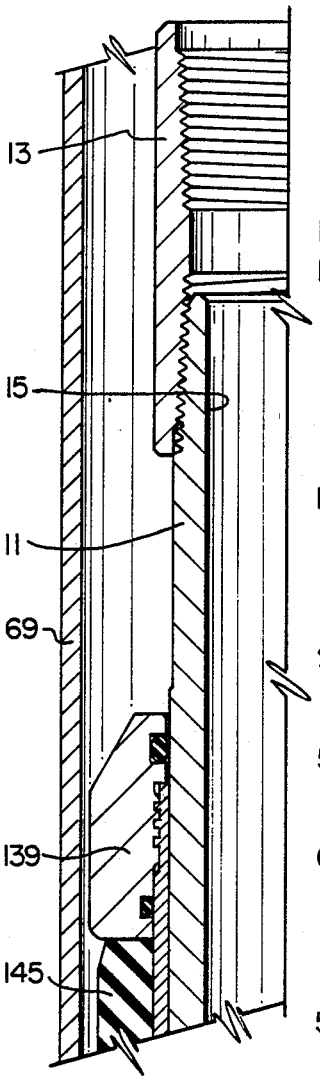
FIG. 2*a* is a side, cross-sectional view of the upper end of the well packer of the invention, similar to FIG. 1*a*, but showing the beginning of the setting operation.
Figure 2B:
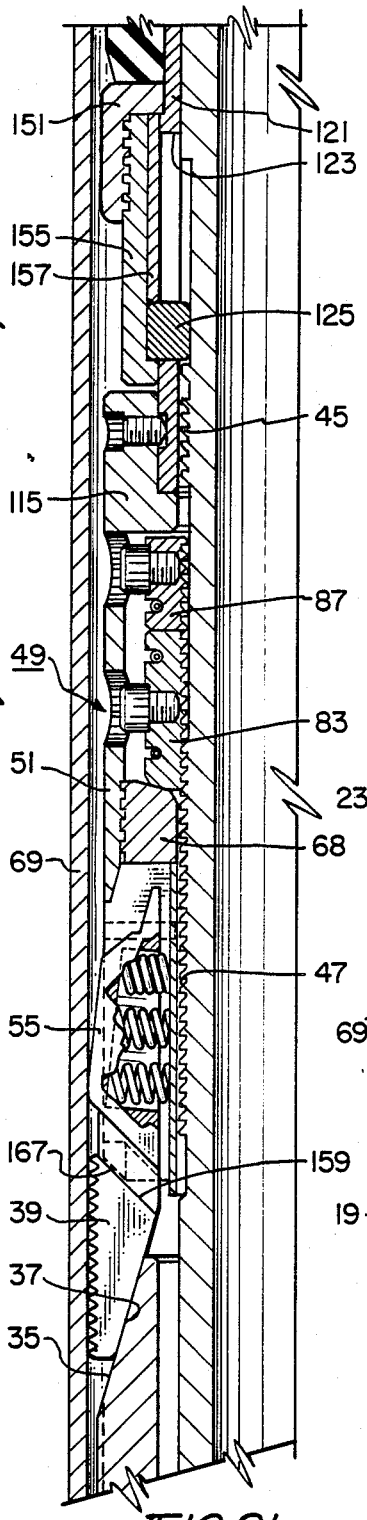
FIG. 2*b* is a downward continuation of FIG. 2*a*, showing the gripping means moved to the extended position.
Figure 2C:
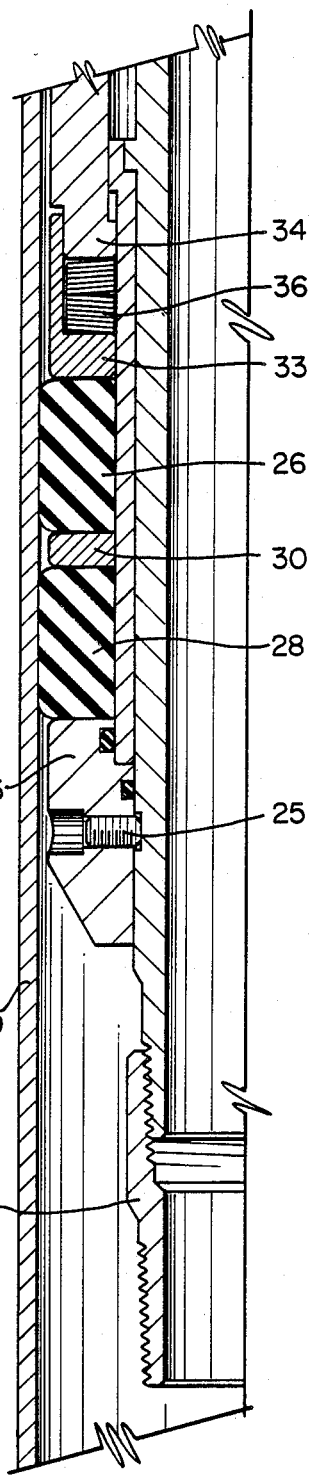
FIG. 2*c* is a downward continuation of FIG. 2*b* showing the lower seal in the extended position.

The operation of the packer will now be described. The packer is run into position within the well casing to a desired location with the respective parts in the position shown in FIGS. 1*a*,-1*c*. The upper and lower seal assemblies 145, 27 are in the restricted position and the rocker type slips are as illustrated in FIG. 1*b* with the gripping surfaces 71 retracted and the drag block portions 55 in contact with the casing walls 69. To set the device, the well string is rotated to the right while holding tension on the well string. This action causes the left hand threads 45 of the mandrel upper threaded region to work up the internally threaded surface of the running ring 87, thereby allowing the mandrel to move upwardly with respect to the cage 68. As the operator continues to pull tension on the well string and the mandrel moves upwardly, the right hand threads of the lower threaded region 47 ratchet into engagement with the internally threaded surface of the setting ring 83. The cone surface 35 of the expander ring 33 contacts the mating tapered surface of the rocker type slips, causing the gripping surfaces 71 to be extended radially outward to contact the surrounding casing 69. Once the teeth of the gripping surface 71 have contacted the casing, movement of the cage 68 is prevented and continued tension on the well string causes the compression surface 31 of the expander ring to begin to expand the lower seal assembly 27. The expanded lower seal assembly 27 and extended slip 39 are shown in FIGS. 2*b*-2*c*. It will be noted that upper threaded region 45 has moved out of engagement with the threaded surface of the running ring 87 while the lower threaded region 47 has ratcheted into engagement with the internally threaded surface of the setting ring 83. The oppositely tapered support surface 159 of the slips 39, is also engaging the mating support surface 169 of the cage 68.

Figure 3A:
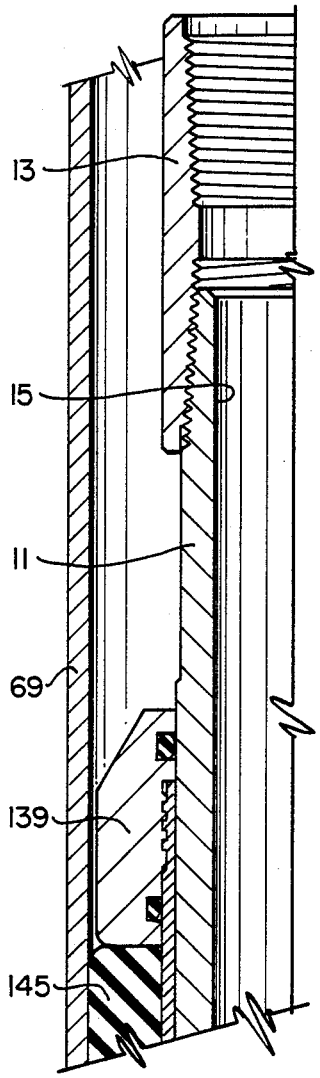
FIG. 3*a* is a side, cross-sectional view similar to FIG. 1*a* but with the upper seal in extended position.

As the mandrel continues to be pulled upwardly and before the lower seal assembly 27 has completely set, the shoulder 135 of the mandrel 11 engages the dogs 125 which, in turn, transmit tension through the tension sleeve 157 to the tension ring 151 and to the top seal assembly 145. This action causes the top seal assembly 145 to be extended radially outward into sealing engagement with the well casing as shown in FIG. 3*a*. This action is possible because the top abutment 139, internal sleeve 121, lower extent 119, upper extent 115, ring housing 51 and slips 39 are all static after the slips 39 have gripped the well casing. Dogs 125 are free to move in the slots 123 and hence to move the tension sleeve 157, extension 155, and tension ring 151.

Figure 3B:
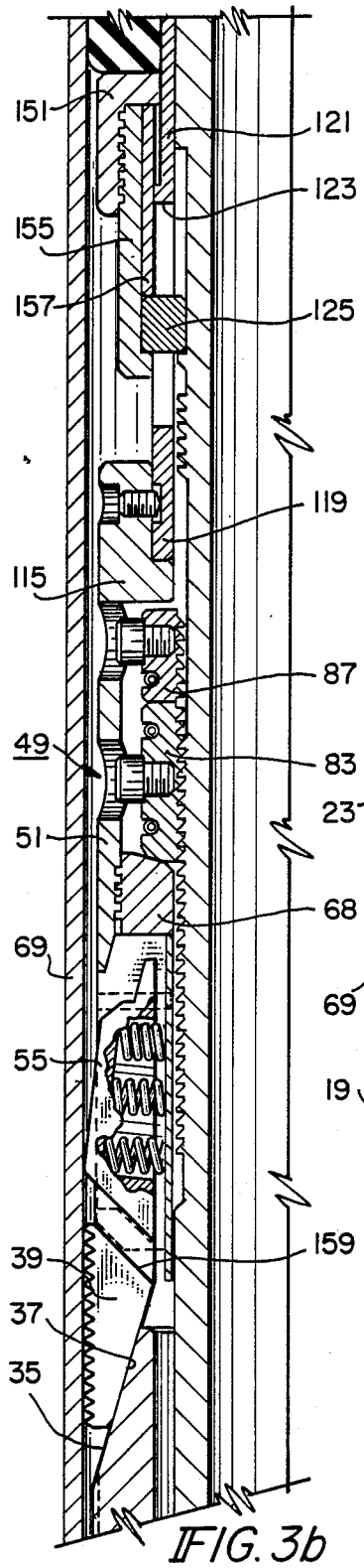
FIG. 3*b* is a downward continuation of FIG. 3*a*.
Figure 3C:
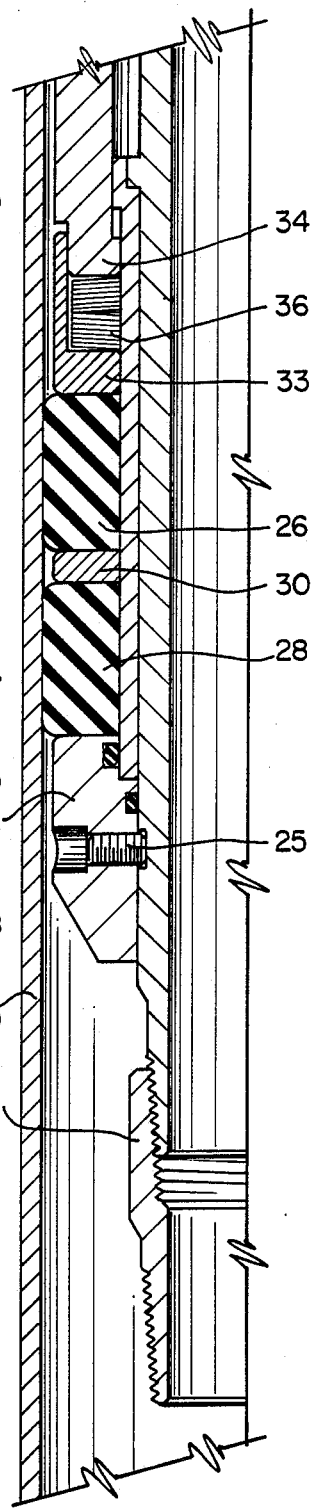
FIG. 3*c* is a downward continuation of FIG. 3*b*.

Because of the ratcheting engagement of the lower threaded region 47 with the setting ring 83, the tension is held in both the upper and lower seal assemblies and the gripping surfaces 71 of the slips continue to grip the well casing. In the position shown in FIGS. 3*a*-3*c*, the rocker type slips continue to anchor the device bydirectionally under both tensive and compressive loads. The mechanical setting mechanism (generally at area 49 at FIG. 1*b*) is isolated from corrosive well fluids by means of the upper and lower seal assemblies.

To release the packer, the operator at the well surface applies compressive loading on the well string and again rotates the well string to the right. Because the lower threaded region 47 engages the setting ring 83 with right hand threads, this action causes the mandrel to "back down" the setting ring and move downwardly. Continued rotation serves to move the expander surface 35 from beneath the slip 39, thereby allowing the upper and lower seals to relax and return to the position shown in FIGS. 1*a*-1*c*. It will be understood that the setting and release mechanism described can be repeated a number of time without the retrieving the device to the well surface.

Where right hand rotation is impossible or undesirable, the packer can also be retrieved by a straight pull release. Shear pins 25 and 117 are both provided with preselected indexes which can be overcome by appropriate tension from the well surface. If the operator continues to pull from the position shown in FIGS. 3*a*-3*c*, and exceeds the preselected index, the pins 25 shear, allowing the lower abutment 23 to fall away and relax the lower seal. The upper shear pins 117 are also sheared, allowing the internal sleeve 121 to separate from the upper extent 115 of the ring housing which allows the upper seal to relax.

An invention has been provided with several advantages. The dual seal packer of the invention can be run into position and set by merely rotating to the right while holding tension on the well string. This single action sets both the upper and lower seal assemblies without additional method steps or movement. The special rocker type slip design with the oppositely tapered lower surface and support surface effectively anchors the packer while using only a single expander ring and expander cone surface and yet remains anchored under both tensive and compressive loading. This is only possible through the unique complementary action of the mating support surfaces of the cage assembly and the slips. The ratcheting mechanism of the mandrel, running ring and setting ring hold the setting force in the seal assemblies and slips and also allow the device to be returned to the running-in position by continued rotation to the right. In the set position, the majority of the mechanical setting parts are isolated from corrosive well fluids, allowing less exotic materials to be utilized with a result in savings in manufacturing cost. The rotational release feature allows the device to be set and released multiple times without retrieving the device to the well surface. A straight pull release is also provided where right hand rotation is not desired.

Although the invention has been shown in only one of its forms, it is not thus limited but is susceptible to various changes and modifications without departing from the spirit thereof.

I claim:

1. A dual seal packer adapted to be releasably set within a surrounding conduit in a well bore, comprising:

a central mandrel having upper connecting means for connection in a well string extending to the well surface;

a cage assembly circumscribing the mandrel at one axial location;

a lower seal assembly carried on the mandrel below the cage assembly and above a lower abutment;

an expander ring carried about the mandrel above the lower seal assembly, the expander ring having a compression surface for contacting the lower seal assembly and an oppositely arranged, tapered cone surface, the lower seal assembly being expansible radially outward upon contact with the compression surface of the expander ring between a retracted position and an extended position in engagement with the surrounding conduit;

a plurality of rocker type slips carried by the cage assembly at spaced circumferential locations above the expander ring, each slip having a length defined by opposing ends thereof, an upper serrated gripping surface at one of said opposing ends and an unserrated drag block surface at the other of said opposing ends, each slip having a tapered lower surface for engagement with the cone surface of the expander ring, an oppositely tapered support surface, and a pivot point which allows the slip to pivot between a retracted position and an extended gripping position in which the serrated gripping surface of the slip engages the surrounding conduit, the cage assembly being provided with a mating support surface for engaging the support surface of each slip when the cone surface of the expander ring engages the tapered lower surface of the slip and the slip moves to the extended, gripping position; and an upper seal assembly carried on the mandrel above the cage assembly and below an upper abutment.

2. A dual seal packer adapted to be releasably set within a surrounding conduit in a well bore, comprising:

a central mandrel having upper connecting means for connection in a well string extending to the well surface;

a cage assembly circumscribing the mandrel at one axial location;

a lower seal assembly carried on the mandrel below the cage assembly and above a lower abutment;

an expander ring carried about the mandrel above the lower seal assembly, the expander ring being axially slidable with respect to the lower seal assembly, having a compression surface for contacting the lower seal assembly, and an oppositely arranged, tapered cone surface, the lower seal assembly being expansible radially outward upon contact with the compression surface of the expander ring between a retracted position and an extended position in engagement with the surrounding conduit;

a plurality of rocker type slips carried about the mandrel at spaced circumferential locations above the expander ring, each slip having a length defined by opposing ends thereof, an upper serrated gripping surface at one of said opposite ends and an unserrated drag block surface at the other of said opposing ends, the slips being carried within windows provided in the cage assembly, each slip having a tapered lower surface for engagement with the cone surface of the expander ring, an oppositely tapered support surface, and a pivot point which allows the slip to pivot between a retracted position and an extended gripping position in which the slip serrated gripping surface engages the surrounding conduit, the cage assembly being provided with a mating support surface located at the approximate pivot point of each of the slips for engaging the support surface of each slip when the cone surface of the expander ring engages the tapered lower surface of the slip and the slip moves to the extended, gripping position; and an upper seal assembly carried on the mandrel above the cage assembly and below an upper abutment.

3. The packer of claim 2, wherein the pivot point of each slip is located approximately mid-way along the length of the slip, the upper gripping surface and tapered lower surface being located at one end of the slip, the opposite end of the slip forming the unserrated drag block surface for engaging the surrounding conduit as the packer is being run into position within the well bore.

4. The packer of claim 3, wherein the drag block end of each slip has a bottom surface which defines a reference plane and wherein the tapered lower surface forms an acute angle with respect to an imaginary line drawn through the plane of the bottom surface, the oppositely tapered support surface forming an obtuse angle with the imaginary line, whereby the cone surface of the expander ring and the support surface of the cage assembly support the slip in both axial directions when the slip is in the extended, gripping position.

5. The packer of claim 4, wherein each of the slips pivots on the cage assembly at a point located on the oppositely tapered support surface of each slip.

6. The packer of claim 5, wherein the window openings in the cage assembly are provided with milled angular profiles which are complimentary to the tapered support surface of each slip, whereby movement of the slip from the retracted to the extended position causes the profile to engage the support surface of the slip to thereby resist forces acting in one axial direction upon the slip.

7. The packer of claim 6, wherein the cage assembly is a tubular body having a plurality of longitudinal slots formed therein, a portion of each slot forming a window for receiving a slip.

8. A dual seal packer adapted to be releasably set within a surrounding conduit in a well bore, comprising:

a central mandrel having an external surface and upper connecting means for connection in a well string extending to the well surface;

a cage assembly circumscribing the mandrel at one axial location;

a lower seal assembly carried on the mandrel below the cage assembly and above a lower abutment;

an expander ring carried about the mandrel above the lower seal assembly, the expander ring being axially slidable with respect to the lower seal assembly, having a compression surface for contacting the lower seal assembly, and an oppositely arranged, tapered cone surface, the lower seal assembly being expansible radially outward upon contact with the compression surface of the expander ring between a retracted position and an extended position in engagement with the surrounding conduit;

a plurality of rocker type slips carried about the mandrel at spaced circumferential locations above the expander ring, each slip having a length defined by opposing ends thereof, an upper serrated gripping surface at one of said opposing ends and an unserrated drag block surface at the other of said opposing ends, the slips being carried within windows provided in the cage assembly, each slip having a tapered lower surface for engagement with the cone surface of the expander ring, an oppositely tapered support surface, and a pivot point which allows the slip to pivot between a retracted position and an extended gripping position in which the serrated gripping surface of the slip engages the surrounding conduit, the cage assembly being provided with a mating support surface located at the approximate pivot point of each of the slips for engaging the support surface of each slip when the cone surface of the expander ring engages the tapered lower surface of the slip and the slip moves to the extended, gripping position;

an upper seal assembly carried on the mandrel above the cage assembly and below an upper abutment; and the central mandrel having upper and lower externally threaded regions which are spaced apart on the mandrel exterior surface, the upper threaded region being engagable with an internally threaded running ring when the seal assemblies and slips are in the retracted position and wherein the lower threaded region is engagable with an internally threaded setting ring when the seal assemblies and slips are in the extended position.

9. The dual seal packer of claim 4, wherein the pitch of the threads of the upper threaded region is opposite the pitch of the threads of the lower threaded region.

10. The dual seal packer of claim 9, wherein the threaded region of the internally threaded running ring and the upper threaded region of the mandrel are engaged with left hand threads which are releasable by right hand rotation of the mandrel from the well surface.

11. The dual seal packer of claim 10, wherein the cage assembly includes a plurality of dogs carried about the mandrel in spaced circumferential locations, the dogs being received on the central mandrel outer surface and being both slidable along the longitudinal axis of the mandrel and rotatable about the circumference of the mandrel.

12. The dual seal packer of claim 11, wherein the dogs are engagable with an external shoulder on the central mandrel and through a tension sleeve with the upper seal assembly, whereby tension applied through the mandrel shoulder and through the dogs is communicated through the tension sleeve to the upper seal assembly to move the seal assembly to the extended position.

13. The dual seal packer of claim 12, wherein the upper and lower externally threaded regions of the central mandrel are spaced-apart a predetermined distance, the distance being selected to allow the lower externally threaded region to engage the setting ring internally threaded surface as the upper and lower seal assemblies are being extended to hold the seal assemblies in the extended position.

14. The dual seal packer of claim 13, further comprising:

shear means connecting the lower abutment to the mandrel, the shear means having a preselected shear resistance to allow release of the lower abutment and, in turn, release of the slips and upper seal assembly when the preselected shear resistance is exceeded by sufficient upward tension on the mandrel.

15. A method of setting a dual seal packer within a surrounding conduit in a well bore, comprising the steps of:

providing a central mandrel having an external surface and upper connecting means for connection in a well string extending to the well surface;

providing a cage assembly circumscribing the mandrel at one axial location;

locating a lower seal assembly on the mandrel below the cage assembly and above a lower abutment;

providing an expander ring carried about the mandrel above the lower seal assembly, the expander ring being axially slidable with respect to the lower seal assembly, having a compression surface for contacting the lower seal assembly, and an oppositely arranged, tapered cone surface, the lower seal assembly being expansible radially outward upon contact with the compression surface of the expander ring between a retracted position and an extended position in engagement with the surrounding conduit;

providing a plurality of rocker type slips carried about the mandrel at spaced circumferential locations above the expander ring, each slip having a length defined by opposing ends thereof, an upper serrated gripping surface at one of said opposing ends and an unserrated drag block surface at the other of said opposing ends, the slips being carried within windows provided in the cage assembly, each slip having a tapered lower surface for engagement with the cone surface of the expander ring, an oppositely tapered support surface, and a pivot point which allows the slip to pivot between a retracted position and an extended gripping position in which the serrated gripping surface of the slip engages the surrounding conduit, the cage assembly being provided with a mating support surface located at the approximate pivot point of each of the slips for engaging the support surface of each slip when the cone surface of the expander ring engages the tapered lower surface of the slip and the slip moves to the extended, gripping position;

locating an upper seal assembly on the mandrel above the cage assembly and below an upper abutment;

providing the central mandrel with upper and lower externally threaded regions which are spaced apart on the mandrel exterior surface, the upper threaded region being engagable with an internally threaded running ring when the seal assemblies and slips are in the retracted position and wherein the lower threaded region is engagable with an internally threaded setting ring when the seal assemblies and slips are in the extended position;

running the mandrel into position on the well string;

rotating the well string to the right while holding tension on the string to release the running ring and allow the mandrel to slide upwardly with respect to the cage assembly; and continuing to pull tension on the string to engage the lower threaded region with the setting ring.

16. The method of claim 15, further comprising the steps of:

continuing to rotate to the right while applying compressive loading on the well string to disengage the lower threaded surface from the setting ring and release the packer.

17. The method of claim 16, further comprising the steps of:

providing shear means which connect the lower abutment to the mandrel, the shear means having a preselected shear index to allow release of the lower abutment and, in turn, release of the slips and upper seal assembly when the preselected shear index is exceeded by sufficient upward tension on the mandrel;

releasing the packer by straight upward pull on the well string.

18. A rocker type slip for use in a well packer of the type having a cage assembly with window openings for receiving a slip, each rocker type slip comprising:

a slip body having a length defined by opposing ends thereof, an upper serrated gripping surface at one of said opposing ends, a tapered lower surface, an oppositely tapered support surface, and a pivot point which allows the slip to pivot between a retracted position and an extended gripping position in which the slip engages the surrounding conduit, and wherein the support surface of the slip is formed at an angle which is complimentary to a mating support surface provided on the cage assembly, engagement of the slip and cage support surfaces serving as the contact point for resisting axial loads imposed upon the slip in one axial direction.

19. The rocker type slip of claim 18, wherein the slip pivot point is located approximately mid-way along the length thereof, the upper gripping surface and tapered lower surface of the slip being located at one end of the slip body, the opposite end of the slip body forming a drag block for engaging the surrounding conduit as the packer is being run into position within the well bore.

20. The rocker type slip of claim 19, wherein the drag block end of each slip has a bottom surface which defines a reference plane and wherein the tapered lower surface forms an acute angle with respect to an imaginary line drawn through the plane of the bottom surface, the oppositely tapered support surface forming an obtuse angle with the imaginary line.

21. The rocker type slip of claim 20, wherein each of the slips pivots, with respect to the cage assembly, at a point located on the oppositely tapered support surface of each slip.

22. The rocker type slip of claim 21, further comprising:

a cage assembly for containing each rocker type slip, the cage assembly comprising a tubular body having a plurality of longitudinal slots formed therein, a portion of each slot forming a window for receiving a slip, and wherein the window openings in the cage assembly are provided with milled angular profiles which are complimentary to the tapered support surface of each slip, whereby pivotal movement of the slip causes the profile to engage the support surface of the slip to thereby resist forces acting in one axial direction upon the slip.

* * * * *